United States Patent [19]

Studebaker et al.

[11] Patent Number: 5,050,530

[45] Date of Patent: Sep. 24, 1991

[54] LIQUID APPLICATOR

[75] Inventors: Roy D. Studebaker, Chehalis; Todd L. Studebaker, Seattle, both of Wash.

[73] Assignee: Wilen Manufacturing Co., Inc., Atlanta, Ga.

[21] Appl. No.: 427,254

[22] Filed: Oct. 25, 1989

[51] Int. Cl.[5] ..... B05C 1/00

[52] U.S. Cl. ..... 118/264; 118/305; 222/191; 222/190; 401/137

[58] Field of Search ..... 118/264, 305; 222/191, 222/190, 174, 508, 608; 401/137, 138, 139, 140; 15/55, 230.17, 231, 50.1, 98

[56] References Cited

U.S. PATENT DOCUMENTS

| | | | |
|---|---|---|---|
| 2,247,956 | 7/1941 | Mandel | 401/139 |
| 3,204,272 | 10/1965 | Greene et al. | 222/191 |
| 3,737,938 | 6/1973 | Saltzstein | 15/231 |
| 3,912,402 | 10/1975 | English | 401/139 |
| 4,443,906 | 4/1984 | Tucker et al. | 15/50.1 |
| 4,822,194 | 4/1984 | Simonette | 401/138 |

*Primary Examiner*—David A. Simmons
*Assistant Examiner*—Robert Barker
*Attorney, Agent, or Firm*—Hurt, Richardson, Garner, Todd & Cadenhead

[57] ABSTRACT

A translucent tank carries along its bottom portion, a pair of transversely extending spaced parallel wick pads which are removeably received in and protrude from recesses in the bottom portion. A handle is pivotally connected along one side of the tank and has control button, both of which control a spring loaded dispensing bar on which are carried resilient valve members which close and open discharge tubes of the tank. A drain tube can empty the contents of the tank to discharge liquid in front of the wick pads. A kick bar releases latches which hold the handle in a transport position with respect to tank. Wheels at the front of the tank permit the handle to tilt the tank for transporting from place to place.

22 Claims, 3 Drawing Sheets

FIG. 2
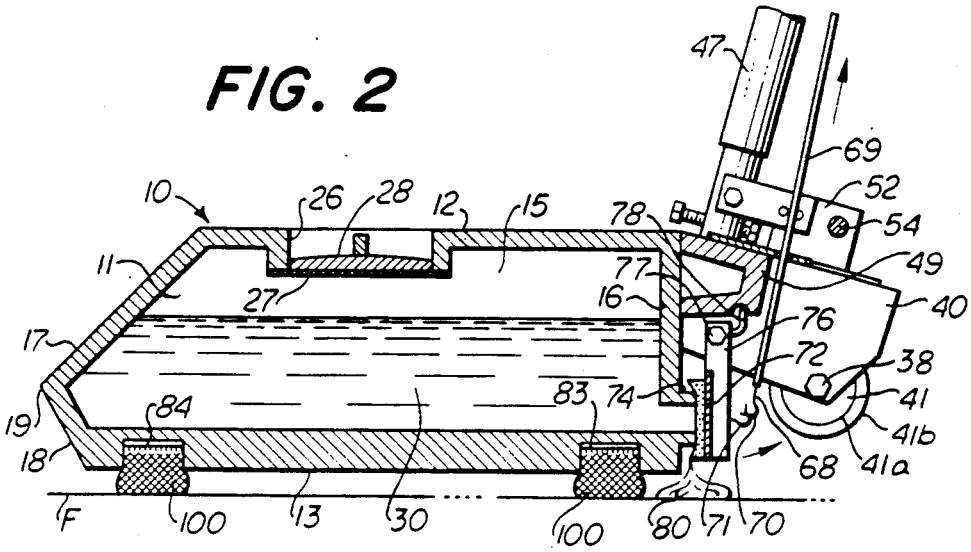
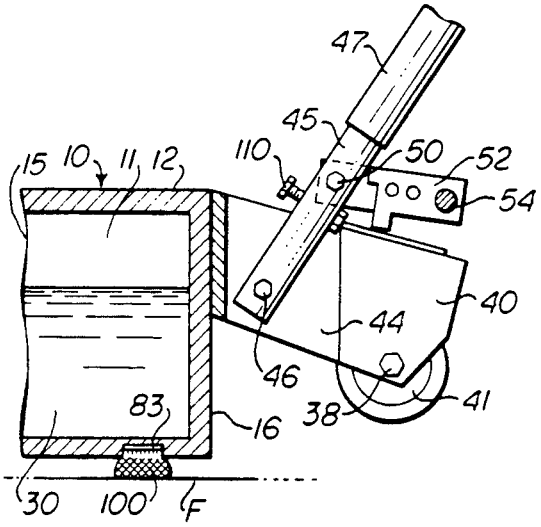
FIG. 3
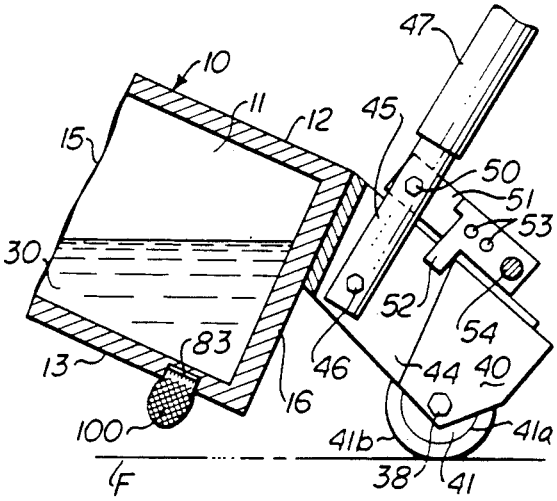
FIG. 4
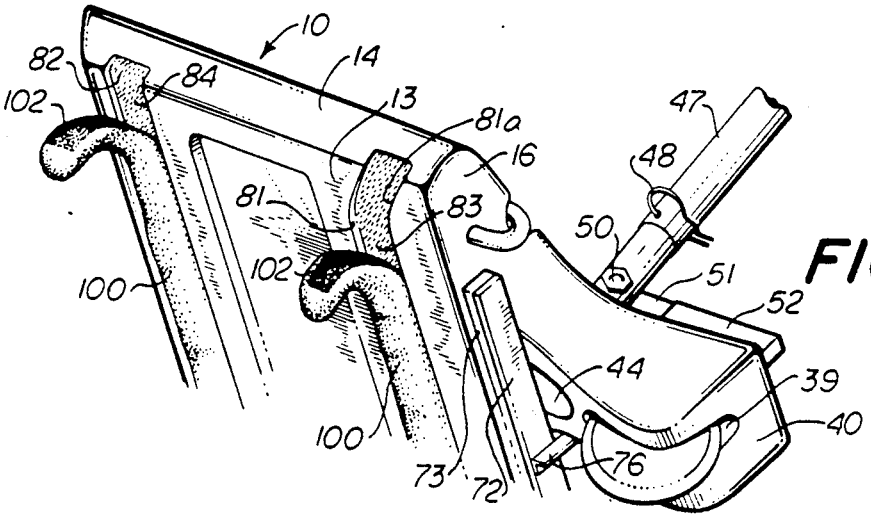
FIG. 5

LIQUID APPLICATOR

FIELD OF THE INVENTION

This invention relates to a liquid applicator and is more particularly concerned with an applicator which will apply a liquid such as wax or varnish to the surface of a floor.

BACKGROUND OF THE INVENTION

In the past, floor treating apparatuses have been devised. Usually these floor treating apparatuses are quite complicated and expensive machines which are difficult to operate and do not uniformly apply the liquid to the floor. The devices are also difficult to flush and have spreaders which are not readily changed.

SUMMARY OF THE INVENTION

Briefly described, the present invention includes a translucent relatively flat tank which is provided along its bottom surface with a pair of longitudinally extending spreader receiving recesses, within which are removeably disposed a pair of parallel longitudinally extending wick pads which support the tank when the applicator is in operation. A handle assembly is pivotally connected to the front side of the tank and extends upwardly to terminate in a transversely extending handle bar. Adjacent to the handle bar are the control buttons or pulse buttons which move a cable upwardly or downwardly. The cable, in turn, is connected to the central portion of a spring loaded valve plate which when not retracted, yieldably urges a plurality of transversely spaced resilient valve members against a like number of rearwardly protruding discharge tubes. Depressing either of the pulse buttons will cause the cable to open the valves and thereby permit the liquid in the tank to be discharged out of the tubes and onto the floor over which the applicator is moved.

Forwardly of the control bar are a pair of transportation wheels which are supported by a pair of transversely spaced forwardly extending brackets. These wheels have outwardly bevelled peripheral sides which converge to a relatively sharp outer periphery so that when the tank is transported, only a minimal width of each wheel's surface contacts the surface over which the tank is to be transported. A kick bar controls latches which latch the handle assembly in generally an upright position with respect to the tank so that when the handle assembly is tilted, the tank is pivoted sufficiently upwardly such that the tank is supported at an angle to the floor on the transportation wheels.

The tank is provided with a removeable cap so that it can be readily and easily filled with liquid and is provided with a drain tube which is recessed into the top of the tank but which can be removed from the recess and pivoted to a lower position where the tank will drain by gravity.

Each of the wick pads is provided with a synthetic plastic foamed absorbent core, around which is arranged a fabric, the texture of which determines the distribution of the liquid. The upper portion of the wick pad is provided with one of the elements of a hook and loop fastener such as "VELCRO" ®, the other element of which is secured to the inner surface which defines a portion of the recess. The front recess, i.e., the recess which is closest to the discharge tubes is curved at its end portions toward the direction of movement of the applicator so that the front wick pad tends to cradle and distribute transversely the liquid which is disposed on the floor ahead of its path of movement. The rear wick pad is of essentially the same construction as the front wick pad and is for the purpose of more uniformly distributing the applied liquid. The recesses and these wick pads extend transversely throughout the width of the bottom portion of the tank and the end portions of the wick pads extend beyond the ends of the tank so that they can contact the floor outwardly thereof on both sides.

Accordingly, it is an object of the present invention to provide a liquid applicator which is inexpensive to manufacture, durable in structure and efficient in operation.

Another object of the present invention is to provide a liquid applicator which can be operated by an unskilled laborer and which will quickly and uniformly dispense liquid along a relatively flat, horizontal surface, such as a floor.

Another object of the present invention is to provide a liquid applicator which can readily and easily dispense liquid floor finishes, sealers or restorers over a large floor area within a short period of time.

Another object of the present invention is to provide a liquid applicator which can be readily and easily flushed.

Another object of the present invention is to provide a liquid applicator in which the wick pads can be readily and easily replaced and in which there are number of different textures of the wick pads for applying and smoothing a different viscosity liquids.

Another object of the present invention is to provide a liquid applicator which can be readily and easily transported over the wet liquid which has been applied.

Another object of the present invention is to provide a liquid applicator in which the dispensing of the liquid can be manually controlled by the operator of the device.

Another object of the present invention is to provide a liquid applicator which is lightweight and can be rapidly moved over the surface for creating a liquid finish over a floor or the like.

Another object of the present invention is to provide a liquid applicator which can be readily and easily operated.

Another object of the present invention is to provide a liquid applicator in which only a small fraction of the liquid which is dispensed, is retained by the pads.

Another object of the present invention is to provide a liquid applicator in which the pads are readily and easily removed and in which the pads can be stored for subsequent use.

Other objects features and advantages of the present invention will become apparent from the following description when taken in conjunction with the accompanying drawings wherein like characters of reference designate corresponding parts throughout the several views.

DESCRIPTION OF THE DRAWINGS

FIG. 2 is a vertical sectional view of a portion of the liquid applicator shown in FIG. 1, the tank being shown in its operating position on a floor and the handle being shown in a latched upright position;

FIG. 3 is a fragmentary vertical sectional view of a portion of the liquid applicator shown in FIGS. 1 and 2 and showing the handle in an unlatched and working position;

FIG. 4 is a view similar to FIG. 3 but showing the handle in a latched position and the tank being tilted to a transportation position;

FIG. 5 is a fragmentary perspective view of a portion of the liquid applicator shown in FIG. 1, the wick pads being partially removed from the tank;

DETAILED DESCRIPTION

Figure 1:
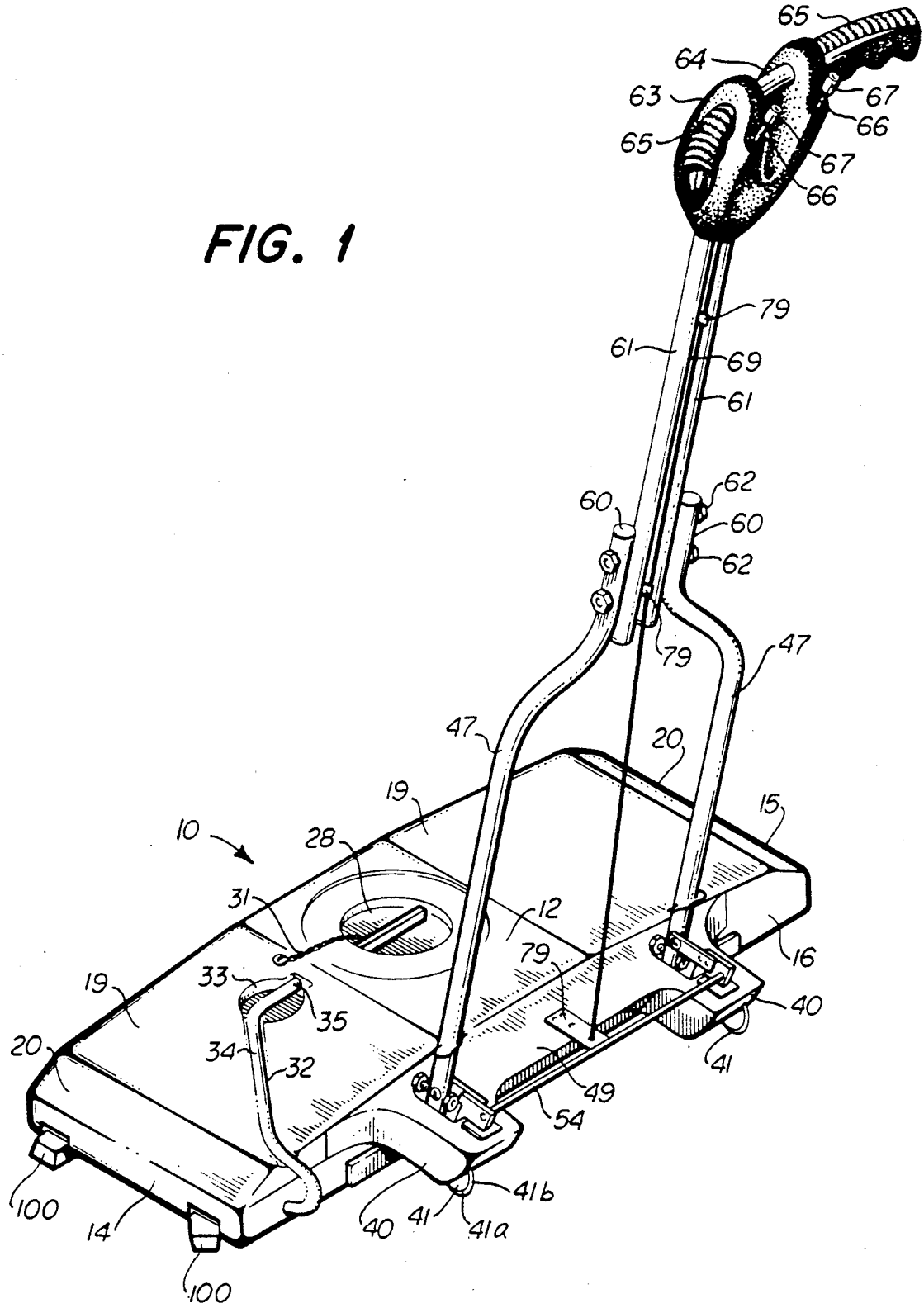
FIG. 1 is a perspective view of a liquid applicator constructed in accordance with the present invention.
Figure 6:
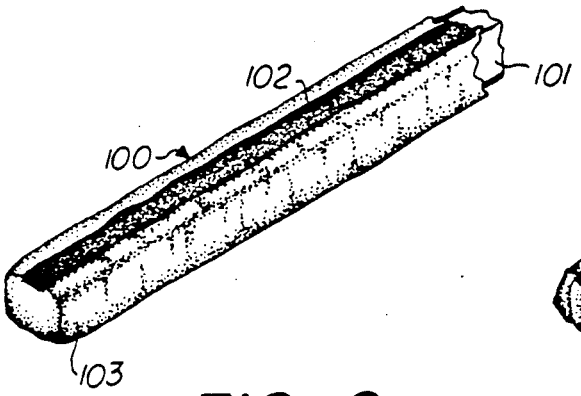
FIG. 6 is a fragmentary perspective view of one form of wick pad used in the liquid applicator of FIG. 1.

Referring now in detail to the embodiment chosen for the purpose of illustrating the present invention, it being understood that in its broader aspects, the present invention is not limited to the exact details herein depicted, numeral 10 denotes the tank of the liquid applicator chosen for the purpose of illustrating the present invention. This tank 10 is formed of plastic such as polypropylene, polyethylene or polyvinylchloride and is translucent, having a hollow interior which defines a liquid containing chamber 11. In more detail, the tank 10, as viewed in FIG. 1 is generally rectangular, having a central top panel 12 and a bottom 13, upright side panels 14 and 15, a front panel 16, and as seen in FIG. 2 rear panels 17 and 18. The rear upper panel 17 tapers from top 12 downwardly and rearwardly, while the rear lower panel 18 tapers upwardly and rearwardly to a common horizontal edge 19 which extends across the rear portion of the tank.

The top panel 12 is a rectangular panel and has downwardly and outwardly tapering wing panels 19 on both sides, the wing panels 19 merging respectively with wing extension panels 20 the edges of which join to the outer edges of the wing panels 19 and the upper edges of the side panels 14 and 15.

In the central portion of the top panel 12 is a cylindrical fill tube or cylinder 26 which protrudes slightly within the chamber 11 and receives, at its lower end, a filter screen 27. A removeable cap 28 is received within the cylinder 26 and rests against the screen 27 when the tank 10 is closed. This cap 28 can be readily removed whenever it is necessary to add to the liquid 30 within the chamber 11. A chain 31 secured to the wing panel 19 and to the cap 28 to prevent the cap 28 from coming disconnected from the tank 10.

As seen in FIG. 1, a recessed channel 32 is provided in one of the top wing panels 19, this channel 32 leading from a cylindrical recess 33 in the uppermost part of the panel 19. This channel 32 receives an intermediate portion of a flexible hose 34, the proximal end of which is connected to a drain tube (not shown) which protrudes through the front wall 16 adjacent to wall 14. The distal end of the tube 34 is received within the cylindrical recess 33 so that the distal end 35 of the hose is normally above the level of the liquid 30 within the chamber 11. When it is desired to drain the liquid from the chamber 11, the tube 34 is removed from its channel 32 and moved to a position where the distal end is below the tank 10 and then the tank is tilted, to drain by gravity. Once the liquid has been removed from the chamber 11, the chamber 11 may be flushed with water or other solvent by introducing the water or solvent through the filling cylinder 26 and draining the flush liquid out through tube 34.

Protruding forwardly from the front side 16 are a pair of brackets 40, there being cavities or recesses 39 in the lower front portions of these brackets to receive the wheels 41. Appropriate bolts or shafts 38 which pass through the brackets 40 and through the wheels 41, respectively, support the wheels 41 for rotation. Each of the wheels 41 has outwardly bevelled edges **41*a* which taper radially outwardly to the peripheral edge 41*b* of that wheel 41. Thus, at the periphery, the wheel 41 is very narrow and therefore when the machine is transported over a wet surface, as illustrated in FIG. 4**, the wheels leave only very narrow tracks which usually will be filled in by the flow of the liquid.

Rearwardly of the wheels 41, the brackets 40 are joined by a skirt 49. Brackets 40 are also provided with generally vertically extending slots or recesses 44 into which are respectively received the base rods 45 of the handle assembly. The base rods, such as rod 45, are transversely opposed to each other and are respectively pivotally carried by pivot pins, such as pivot pin 46, seen in FIGS. 3 and 4. The handle assembly is bifurcated, having a pair of opposed upwardly and inwardly extending hollow tubular braces 47, the lower ends of which are received over the upper end portions of the rods 45. Appropriate clevice clips, such as clip 48, seen in FIG. 5, pass through aligned holes in the lower portion of the braces 47 and the rods 45 so as to lock the same together.

Secured by pivot pins, such as pivot pin 50, seen in FIGS. 3 and 4, are a pair of forwardly extending latch arms 51 to which are secured L-shaped latch members 52, these latch pins being secured by rivets 53. The latch fingers of the latches 52 protrude downwardly and are adapted to be respectively received in the recesses 44, when the handle assembly is pivoted forwardly. The forwardmost portions of the latches 52 are joined by a kick bar 54.

When the handle assembly is moved to its essentially vertical position, as shown in FIGS. 2 and 4, the weight of the latch bars 51, the latch 52 and the kick bar 54 is sufficient to cause the finger of the latches 52 to fall into their respective recesses 44. The handle assembly may then be moved rearwardly so as to tilt tank 10 on floor F to its transportation position, inclined as shown in FIG. 4. When, however, the tank 10 is returned to its work position, resting on wick pads 100, the kick bar 54 can be lifted to remove the latches from their recesses 44, the handle assembly can pivot forwardly to the towing position, shown in FIG. 3.

As seen in FIG. 1, the braces 47 converge toward each other and terminate in upper end portions 60 which are in spaced, opposed, parallel relationship for receiving, therebetween, the lower end portions of the straight parallel handle members 61. The handle members 61 are tubular members, the lower end portions of which are provided with holes which align with holes in the tubes 60 for receiving bolts 62 therethrough.

At the upper end of the tubular members 61 is a hollow plastic yoke 63, through which protrudes a transverse handle bar 64, the ends of which extend in opposite directions and are provided with appropriate elastomeric grips 65.

Protruding upwardly from the interior of the yoke 63 are a pair of arms 66 of a U-shaped member, the upper ends of the arms 66 being provided with pushbuttons 67, respectively. When either of the pushbuttons 67 is depressed, it withdraws a cable 68 seen in FIG. 2 within a tube 69. Tube 69 is guided by guides 79 attached to members 61 and skirt 49. The cable 68 is provided at its lower end with a hook 70 which engages a hook 71 connected to the back side of a flat transversely extending valve plate 72. The rear surface of valve plate 72 carries a plurality of transversely spaced valve members 73, as seen in FIGS. 2 and 5. Preferably, there is one valve member in the central part of the valve plate 72 and a pair of opposed valve members 73 which are at the ends of the valve plate 72. These valve members 73 respectively seat against the ends of transversely spaced discharge tubes, such as tubes 74 which extend forwardly through the wall 16 of tank 10, these tubes 73 respectively communicating with the chamber 11 of the tank 10 at the bottomost portions of the tank 10.

The plate 72 is below skirt 49 and suspended by a pair of downwardly extending brackets, such as bracket 76, which are pivotally carried by bolts, such as bolt 77, which respectively extend into the brackets 40. Springs, such as spring 78, which act against skirt 49, is wrapped around the bolt 77 and yieldably urge the plate 72 rearwardly so as to normally seat the valve members 73 against the ends of their respective tubes, such as tube 74 and thereby close them. When either of the pulse buttons 67 is depressed, this retracts the cable 68 so as to pivot the plate 72 forwardly, against spring compression of spring 78 and thereby holds the valve members 74 away from their valve tubes, such as tube 73. This releases liquid from chamber 11 to produce puddles of liquid, such as puddle 80 seen in FIG. 2 to floor F. The buttons 67 are then released so that the spring 78 seats the valve members, such as valve member 73 against the respective tubes, such as tube 74.

As best seen in FIG. 5, the bottom or lower portion 13 of tank 10 is provided with a pair of longitudinally spaced transversely extending recesses 81 and 82. The rear recess 82 extends in a straight transverse path from one side 14 to the other side 15. The front recess 81 extends parallel to the recess 82 throughout substantially its entire length; however, its end portions, such as portion 81*a* in FIG. 5, curve forwardly. The upper wall which defines the recess 81 and the upper wall which defines recess 82 are respectively provided with "VELCRO" ® elements, such as hook members 83 and 84.

Any pair of the wick pads 100, 200, 300, or 400, depicted in FIGS. 6, 7, 8, and 9, may be selectively installed in the recesses 81 and 82. Each of these wick pads 100, 200, 300, or 400 is a long straight flexible absorbent tubular member which has a resilient absorbent core, such as core 101 in FIG. 6. Also, each of these wick pads has a tufted member of a "VELCRO" ® pair which is adapted to be received by the hook members 83 and 84 seen in FIG. 5. For example, the wick pad 100 has a "VELCRO" ® element, i.e., a tufted member 102 extending along the backside, the wick pad 200 has tufted member 202, the wick pad 300 has tufted member 302 and the wick pad 400 has tufted member 402. Otherwise, the core of the wick pad, such as core 101 is covered with porous fabric. Wick pad 100 is covered with a light cotton flannel 103 to form a light wick pad.

Figure 7:
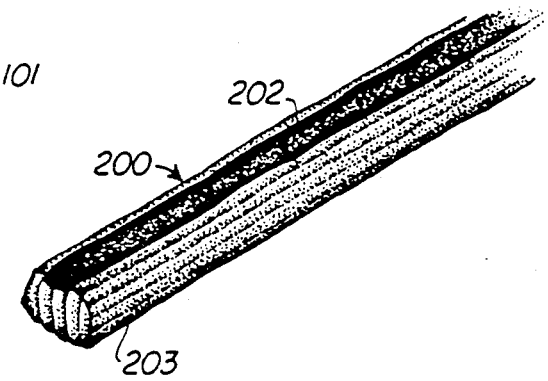
FIG. 7 is a view similar to FIG. 6 and showing still another form of wick pad.

In FIG. 7 the wick pad 200 is covered with a corduroy fabric 203. This corduroy fabric has its warp or stripes running longitudinally along the length of the wick pad 200.

Figure 8:
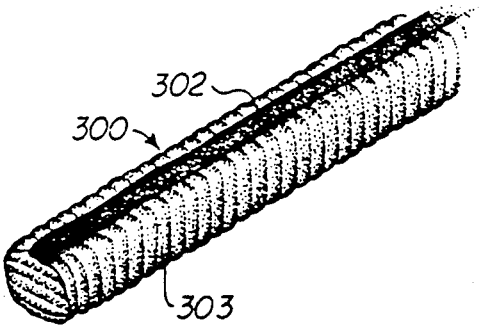
FIG. 8 is a view similar to FIGS. 6 and 7 showing still another form of wick pad.
Figure 9:
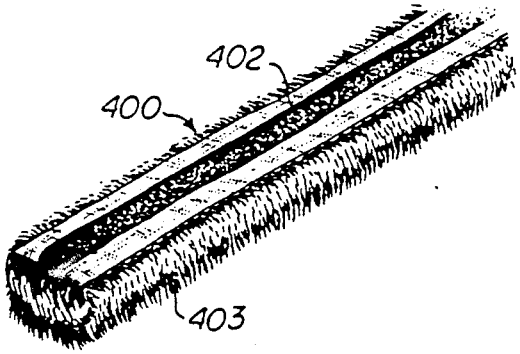
FIG. 9 is a view similar to FIGS. 6, 7, and 8 but showing still another form of wick pad.

Still another type of wick pad which employs corduroy is shown as wick pad 300 in FIG. 8. In that embodiment, the warp or stripes of the corduroy extend partially around the wick pad, this corduroy fabric being denoted by the numeral 303. In FIG. 9, an extra heavy style of wick pad is illustrated which has its surface covered with furry material, namely lamb's wool, the lamb's wool being denoted by the numeral 403.

In use, the selected pair of wick pads, such as wick pad 100, are installed respectively in the grooves 81 and 82, as depicted in FIG. 5 by simply pressing the "VELCRO" ® member 102 against the "VELCRO" ® member 84. The liquid, such as liquid wax, is then supplied to tank 10 by removing the cap 28 and pouring the liquid 30 therein. Next, the liquid is released to form puddles 80 and the tank is moved back and forth so as initially to wet the wick pads 100. Thereafter, the tank 10 can be towed by a person, using the handle bar 64, as the tank 10 is solely supported on the two wick pads. When the towing is commenced, the kick bar 54 is raised so as to release the latches 52 to permit the handle assembly to pivot forwardly to a towing position as shown in FIG. 3. The angular position of the handle assembly, for towing may be adjusted using a set screw 110, seen in FIG. 3. This set screw 110 abutts the upper edge of the portion of bracket 40 which defines the recess 44.

As the tank 10 is towed, one or both of the pulse buttons 67 periodically are manually depressed, so as to accumulate puddles, such as puddle 80, in front of the front pad 100. Three transversely spaced puddles, such as puddle 80, are created simultaneously when the pulse button 67 is depressed, and these puddles will disappear as the tank 10 is towed. Therefore, the pulse buttons 67 must be periodically pushed and then released in order to create successive puddles of the liquid such as puddle 80 in FIG. 2.

As explained before, each time the pulse buttons 67, or either of them, is depressed, the cable 68 in FIG. 2 is retracted, to thereby pivot the valve plate 72 away from the ends of the tubes, such as tube 64. As the tank 10 is towed along a floor the front wick pad, such as wick pad 100, will initially spread the liquid of the puddles 80 and the rear wick pad 100 will distribute the applied liquid from after action by the front pad to produce a uniform strip of liquid on floor F. When a person reaches the end of his path in one direction, the tank 10 may be lifted by simply moving the handle rearwardly until the latches 52 fall into place as the handle assembly reaches its upright position. Thereafter, the handle assembly may be pivoted forwardly so as to raise the tank 10 to an angular position, pivoting about the transportation wheels 41. Thereafter, the tank 10 may be moved to a position to start applying a second strip of liquid. In applying the second strip of liquid, it is preferable to overlap slightly the preceeding strip of liquid with the wick pads 100.

The ends of the wick pads protrude beyond the side panels 14 and 15 and therefore can apply the liquid to the edges of the floor F, without engaging the wall or wall board. The liquid may be applied as fast as a person normally walks, provided that person depresses the pulse buttons periodically so as to maintain an appropriate amount of fluid in front of the front wick pad. The forwardly curved end portions 81*a* of the recess 81 cause the front wick pad 100, which is quite flexible, to be curved forwardly at its end portions when the wick pad is received in the recess 81 and, hence, the end portions of the wick pad 100 will direct the liquid inwardly and thus maintain the liquid in front of the front wick pad 100 as it is pulled along the surface of floor F.

When the coating of the floor F has been completed, the tank 10 is drained using the drain tube 34 and, the wick pads 100 are removed by pulling them away from the "VELCRO" ® elements 83 and 84. The wick pads can then be rinsed in water or other solvent compatible with the liquid which is applied. For example, these pads may be stored in a plastic bag for subsequent use.

It will be obvious to those skilled in the art that many variations may be made in the embodiment here chosen for the purpose of illustrating the present invention, without departing from the scope thereof as defined by the appended claims.

We claim:

1. A liquid applicator for applying liquid to a floor, comprising:

(a) a tank for containing a liquid to be applied to the floor adapted for movement in a longitudinal path of movement over the floor, said tank having a bottom portion;

(b) a pair of transversely extending longitudinally spaced flexible wick pads removeably secured to said bottom portion of said tank, said wick pads protruding from beneath said tank and being adapted to movably support said tank upon the floor;

(c) means for moving said tank in the longitudinal path of movement;

(d) a plurality of spaced liquid outlets adjacent said tank for discharging liquid from said tank ahead of said wick pads;

(e) valve means for opening and closing said outlets for permitting the flow of liquid from said tank through said outlets when said valve means is opened and for interrupting the flow of liquid from said outlets when said valve means is closed; and (f) control means connected to said valve means and mounted to said means for moving said tank for controlling the opening and closing of said valve means.

2. The liquid applicator defined in claim 1 wherein said tank is provided with a pair of spaced transversely extending recesses formed in said bottom portion of said tank for receiving said transversely extending flexible wick pads.

3. The liquid applicator defined in claim 1 including a pair of spaced transversely extending hook and loop fastening elements affixed to said bottom portion and other hook and loop fastening elements connected to said wick pads for respectively engaging said hook and loop fastening elements of bottom portion of said tank.

4. The liquid applicator defined in claim 2 including hook and loop fastening elements receiving within said recesses and hook and loop fastening elements secured to said sick pads and adapted to engage said hook and loop fastening elements in said recesses.

5. The liquid applicator defined in claim 1 wherein said tank has a top portion which is provided with a recess and a flexible drain tube normally received within said recess and communicating with said bottom portion of said tank, said drain tube being removeable from said recess for discharging the liquid from said tank.

6. The liquid applicator defined in claim 1 wherein said wick pads each include a resilient absorbent core and porous material surrounding said resilient absorbent core.

7. The liquid applicator defined in claim 1 wherein said wick pads constitute a front wick pad and a back wick pad and wherein said front wick pad has end portions which protrude from beneath said tank and which extend forwardly of the remaining portion of said front wick pad along the longitudinal path.

8. The liquid applicator defined in claim 1 including a pair of brackets extending forwardly from said tank and a pair of wheels rotatably carried by said bracket for engaging the floor when said liquid applicator is tilted to an angular position.

9. The liquid applicator defined in claim 8 wherein said wheels are bevelled along their peripheral edges for providing wheels which have narrow peripheral surfaces for engaging the said floor.

10. The liquid applicator defined in claim 1 wherein said means for moving said tank includes a handle assembly comprising an upper portion and a lower portion, said lower portion of said handle assembly being bifurcated and said upper portion of said handle assembly including a transverse handle, said bifurcated lower portion of said handle assembly being pivotally mounted to said liquid applicator and latch means for latching said handle assembly in an upright position with respect to said tank.

11. The liquid applicator defined in claim 10 including a pair of wheels mounted on a forward portion of said tank, said handle assembly being also mounted on the forward portion of said tank, said wheels being normally out of engagement with the surface over which said liquid applicator travels but being engageable with said surface when said handle assembly is pivoted for tilting said liquid applicator to an inclined position.

12. The liquid applicator assembly defined in claim 11 wherein said latches are provided with a transversely extending kickbar connecting said latches, said kick bar being moveable for releasing said latches to permit pivotal movement of said handle from its upright position to an angular position in which said tank can be towed by said handle assembly while said wick means engage said floor.

13. The liquid applicator defined in claim 12 wherein said liquid outlets comprise a plurality of spaced tubes each having an open end and protruding through said tank and wherein said valve means comprises a transversely extending flat plate extending across said open ends of said tubes and valve members carried on said plate for simultaneously closing said plurality of tubes and said control means being adapted for moving said plate from an open position spaced away from said tubes to a seated position in which said plate disposes said valves flatly against said open ends of said tubes.

14. The liquid applicator defined in claim 13 wherein said control means includes a pulse button on said handle assembly adjacent to said handle bar and a cable connected to said pulse button and said plate for moving said plate away from said tubes when said pulse button is manually actuated.

15. The liquid applicator defined in claim 1 wherein said wick pads each include a resilient absorbent core and a corduroy fabric covering for said core.

16. The liquid applicator defined in claim 1 wherein said wick pads each include a resilient absorbent core and a furry fabric surrounding a portion of said core.

17. The liquid applicator defined in claim 1 wherein said wick pads have ends which extend in opposite directions outwardly beyond the sides of said tank.

18. The liquid applicator defined in claim 1 wherein said wick pads each include a resilient absorbent core, fabric surrounding a portion of said core and hook and loop fastening elements respectively along the remaining portions of said wick pads, said tank having longitudinally spaced transversely extending recesses for receiving said wick pads and including hook and loop fastening elements secured within said recesses, said hook and loop fastening elements of said core being engageable with said hook and loop fastening elements of said recesses for removeably mounting said wick pads within said recesses, said wick pads being of greater depth than said recesses for extending outwardly below the bottom surface of said tank.

19. The liquid applicator defined in claim 18 wherein said wick pads are each elongated elements which are longer than the width of said tank, whereby when said wick pads are mounted in their respective recesses, they protrude beyond the sides of said tank.

20. The liquid applicator defined in claim 19 wherein said tank is translucent.

21. A wick member for use with a liquid applicator of the type for spreading a liquid on a surface, said wick member being adapted to be removably mounted to the liquid applicator and comprising:

a flexible tubular member formed of fabric, the outer ends of said tubular member being closed;

a yieldable porous material within the interior of said fabric member; and one element of a hook and loop fastener means positioned axially along said fabric member, said one element being adapted to be removably secured to a second element of a hook and loop fastening means positioned on the liquid applicator for removably retaining said fabric member against the liquid applicator.

22. In a liquid applicator of the type adapted to be movably supported upon a surface for spreading liquid over the surface, the improvement comprising:

an elongated recess formed in an underside portion of the liquid applicator containing a reservoir and of the type for spreading a liquid on a surface;

an elongated wick member sized and adapted to be mounted to the liquid applicator adjacent said recess; and hook and loop fastening means mounted to the liquid applicator adjacent said recess and mounted to said wick member for removably securing said wick member to the liquid applicator adjacent said recess.

* * * * *